United States Patent [19]

Stemke

[11] Patent Number: 4,891,146

[45] Date of Patent: Jan. 2, 1990

[54] HYDROPEROXIDIZED ETHYLENE COPOLYMERS AND TERPOLYMERS AS DISPERSANTS AND V. I. IMPROVERS

[75] Inventor: Jeffrey E. Stemke, Petaluma, Calif.

[73] Assignee: Chevron Research Company, San Francisco, Calif.

[21] Appl. No.: 148,466

[22] Filed: Jan. 26, 1988

Related U.S. Application Data

[63] Continuation of Ser. No. 422,320, Sep. 23, 1982, abandoned.

[51] Int. Cl.[4] ..... C10M 107/16

[52] U.S. Cl. ..... 252/55; 252/52 R

[58] Field of Search ..... 252/55, 52 R; 41/62

[56] References Cited

U.S. PATENT DOCUMENTS

| | | | |
|---|---|---|---|
| 3,899,433 | 8/1975 | Unick | 252/52 R |
| 3,899,434 | 8/1975 | Gardiner | 252/55 |
| 4,051,048 | 9/1977 | Elliott | 252/51.5 A |
| 4,051,050 | 9/1977 | Elliott | 252/56 R |
| 4,089,794 | 5/1978 | Engel | 252/51.5 A |
| 4,138,370 | 2/1979 | Elliott | 252/51.5 A |
| 4,382,007 | 5/1983 | Chafetz | 252/51.5 A |
| 4,517,104 | 5/1985 | Bloch | 252/51.5 A |

FOREIGN PATENT DOCUMENTS

| | | | |
|---|---|---|---|
| 2127418 | 4/1984 | United Kingdom | 252/55 |

*Primary Examiner*—William R. Dixon, Jr.
*Assistant Examiner*—James M. Hunter, Jr.
*Attorney, Agent, or Firm*—R. C. Gaffney; C. J. Caroli

[57] ABSTRACT

Lubricating oil compositions containing multifunctional additives, e.g. sludge dispersants and V.I. improvers, and the use of the composition to lubricate the crankcase of an internal combustion engine are disclosed. The additives are prepared by hydroperoxidizing ethylene copolymers and terpolymers.

15 Claims, No Drawings

HYDROPEROXIDIZED ETHYLENE COPOLYMERS AND TERPOLYMERS AS DISPERSANTS AND V. I. IMPROVERS

This is a continuation of application Ser. No. 422,320, filed Sept. 23, 1982, now abandoned.

BACKGROUND OF THE INVENTION

1. Field of the Invention

The present invention relates to lubricating oil compositions which contain oil soluble hydroperoxidized polymeric additives which improve the sludge and varnish dispersancy as well as improving the viscosity index characteristics of the lubricating oil.

2. Description of the Prior Art

An important property of a lubricant composition is the rate at which its viscosity changes as a function of temperature. The relationship between the viscosity and temperature is commonly expressed in terms of the viscosity index (V.I.). Lubricant compositions which change little in viscosity with variations in temperature have greater viscosity index than do compositions whose viscosity is materially affected by changes in temperature. It is readily apparent, therefore, that one of the major requirements of lubricating oils or other hydrocarbon oil products is their satisfactory viscosity-temperature characteristics. These characteristics are necessary in order that the oil's viscosity will not become too low but will show an equally good performance within a relatively wide temperature range to which it may be exposed in service. The wider the possible temperature variations, the smaller should be the change in viscosity with temperature. Hence, the viscosity-temperature characteristics of a lubricant which is used in applications where wide variations in temperature are encountered are of great importance and lubricant compositions having high viscosity indices are highly desirable.

Also, lubricants for modern, high compression, piston-type internal combustion engines must necessarily have high detergency properties, i.e., they must have efficient sludge and varnish dispersant action and chemical and thermal stability in order to free the engines from deposits of varnish, sludge and coke-like materials. Generally, a heavy duty detergent type slubricating oil is employed in such engines in order to maintain the desired high degree of engine cleanliness and thereby promote longer engine life.

A variety of polymeric or high molecular weight materials have been described as viscosity index improvers for lubricants. For example: U.S. Pat. Nos. 3,551,336 and 3,691,078 teach the preparation of ethylene copolymers which act as viscosity index improvers for lubricants.

U.S. Pat. No. 3,417,020 teaches a process for preparing viscosity index improvers by reacting an olefinic polymer with ozone and reduction of the resulting ozonolysis product until carbonyl groups are formed thereon.

U.S. Pat. No. 3,417,020 teaches lubricating oil compositions of improved viscosities containing degraded ethylene-alpha-olefin polymers wherein the degraded polymers have been hydroxylated. The hydroxylated degraded polymers are prepared by hydroperoxidizing the polymer with subsequent reduction of the hydroperoxide groups to yield degraded products containing hydroxyl groups and minor amounts of carboxyl, keto and aldehyde groups U.S. Pat. No. 3,756,954 teaches the preparation of viscosity index improvers prepared by air oxidation of interpolymers of ethylene and propylene in the presence of an aliphatic amine.

British Patent No. 2,040,296A teaches the preparation of a viscosity index improver additive by oxidatively and mechanically degrading an ethylene copolymer containing as one of its components from 0.05 to 3% of 2,5-norbornadiene.

Also, a variety of compositions comprising polymeric or high molecular weight materials which incorporate nitrogen have been described as dispersants and as viscosity index improvers for lubricants. For example:

U.S. Pat. No. 3,316,177 teaches reaction of polyamine with the reaction product of maleic anhydride with an oxidized interpolymer of ethylene and propylene, as a sludge dispersant in lubricant and fuel compositions.

U.S. Pat. No. 3,404,091 describes the preparation of nitrogen containing polymers, useful as sludge dispersants and viscosity index improvers, by grafting polar monomers such as acrylonitrile onto hydroperoxidized ethylene-propylene copolymers.

U.S. Pat. No. 3,404,092 describes the preparation of polymeric viscosity index improvers containing urethane groups by the reaction of hydroxylated ethylene-propylene copolymers with isocyanates.

U.S. Pat. No. 3,687,849 describes the preparation of viscosity index improvers, pour point depressants and dispersants, for fuels and lubricants, by grafting various unsaturated monomers onto a degraded, oxidized, interpolymer of ethylene and propylene.

U.S. Pat. No. 3,687,905 describes the preparation of additives for fuels and lubricants by the reaction of an unsaturated acid, such as maleic acid or anhydride, with an oxidized, degraded interpolymer of ethylene and propylene, followed by reaction with a polyamine.

British Patent No. 983,040 describes the preparation of detergent additives for lubricants by the reaction of a polyamine with a long chain monocarboxylic acid prepared by oxidation of an olefin polymer.

British Patent No. 1,027,410 describes the preparation of ashless detergents for lubricating oils by the reaction of a polyhydroxyamine with a polymeric monocarboxylic acid.

British Patent No. 1,172,818 describes the preparation of additives for lube oils by the condensation of an amine with an ozonized polymer.

U.S. Pat. No. 3,769,216 discloses the preparation of lube oil additives by the condensation of an amine with an oxidized ethylene-propylene copolymer, prepared by air blowing in the presence of a peroxide (also see U.S. Pat. 3,785,980), or by mastication of the polymer in the presence of oxygen.

We have now found, however, that dispersant-viscosity index improvers for lubricating oils may be prepared from hydroperoxidized ethylene copolymers and terpolymers which additives contain an excess of carboxylic acid groups over hydroxyl groups, and, further, that functionalization with amines is not required.

SUMMARY OF THE INVENTION

The present invention advantageously provides an effective oil composition with an ash-free detergent type inhibitor and dispersant and further, the hydroperoxidized polymeric additives used in the lubricating oil composition of this invention are very effective in markedly improving the viscosity index of the lubricating oil compositions to which they are added while concomitantly having excellent thickening power and shear stability.

More specifically, the present invention is concerned with a lubricating oil composition comprising an oil of lubricating viscosity and from about 0.05 to 2% by weight of a dispersancy and viscosity index improving hydroperoxidized copolymer of ethylene with one or more alpha-olefins or terpolymer of ethylene, one or more alpha-olefins and one or more non-conjugated diolefins wherein said copolymer and terpolymer has an excess of carboxylic acid to hydroxy groups. The polymeric additive is prepared by dissolving in a solvent a copolymer of ethylene and a $C_3$–$C_{18}$ alpha-olefin or a terpolymer of ethylene, a $C_3$–$C_{18}$ alpha-olefin and a $C_5$–$C_{12}$ non-conjugated diolefin, having a molecular weight in the range of 20,000 to 1,000,000, reacting the copolymer or terpolymer with oxygen in the presence of a free radical initiator, the reaction being carried out at a temperature of from about 60° to 250° C. under a pressure of from 0 to 1000 psig.

Another embodiment of this invention is a method of lubricating the crankcase of an internal combustion engine by contacting the surface of the engine with the oil composition containing the hydroperoxidized polymer additive.

DETAILED DESCRIPTION OF THE INVENTION

The term "copolymer of ethylene with one or more alpha-olefins" as used herein and in the appended claims, refers to essentially amorphous copolymers derived from essentially ethylene and alpha-olefins containing from 3 to 18 carbon atoms. The alpha-olefins have the structure $R—CH{=}CH_2$, where R is $C_1$ to $C_{16}$, preferably, $C_1$ to $C_8$ alkyl radical and preferably $C_1$ alkyl.

Representative examples of the alpha-olefins include: propylene; 1-butene; 4-methyl-1-pentene; 1-pentene; 1-hexene; 1-heptene; 1-octene; 1-nonene; 1-decene; 5-methyl-1-1-nonene; 5,5-dimethyl-1-octene; 4-methyl-1hexene; 4,4-dimethyl-1-pentene; 5-methyl-1-hexene; 4-methyl-1-heptene; 5-methyl-1-heptene; 1-heptadecene, etc. Propylene is the most preferred alpha-olefin.

These copolymers can be prepared using Ziegler-type catalysts. These reactions are well known and are conventionally employed. Accordingly, the present invention is not predicated upon the particular catalyst system employed in preparing the copolymer starting materials.

Additionally, terpolymers may be employed for producing the dispersant-viscosity index improvers herein contemplated. The terpolymers contain ethylene, the same alpha-olefins described above, but in addition small mole percentages, such as from 0.1 to 15%, and preferably, from 1 to 10% of a third unsaturated monomer, viz., a non-conjugated diolefin is employed. These terpolymers are also prepared by conventional processes using Ziegler-type catalysts and forms no part of the invention so far as the production of the terpolymers is concerned. Examples of such third monomers are $C_5$ to $C_{12}$ acyclic or alicyclic non-conjugated diolefins, such as 1,4-hexadiene, 1,4-pentadiene, 2-methyl-1,5-hexadiene, 1,7-octadiene, 5-methylene-2-norbornene, 1,4-cyclohexadiene, etc.

Methods of preparation of the copolymers and terpolymers are well known; such methods as described in many U.S. patents, such as, among others, U.S. Pat. Nos. 2,700,633; 2,726,231; 2,792,288; 2,933,480; 3,000,866; 3,063,973; 3,083,621; 2,799,668; 2,975,159 and others.

The ethylene monomer unit concentration in the polymers of the present invention ranges in general from about 30 mol percent to about 80 mol percent, with about 20 mol percent to about 70 mol percent of the higher alpha-olefin, and 0 to about 15 mol percent of the diolefin. Preferably, the ethylene-higher alpha-olefin copolymers and terpolymers have viscosity average molecular weights ranging from about 20,000 to 1,000,000, preferably, about 40,000 to 500,000.

In accordance with the present invention, the heretofore mentioned copolymers and terpolymers are employed as starting materials in a controlled hydroperoxidation reaction using molecular oxygen in the presence of a free radical initiator or mixture of free radical initiators. More specifically, the hydroperoxidized ethylene copolymers and terpolymers which are used in the compositions of this invention are prepared by dissolving the polymer in an inert solvent at a temperature in the range of from about 60° C. to 250° C. using agitation. A free radical initiator is added and oxygen, preferably in the form of air, is added to the reaction medium under a pressure of from 0 to 1,000 psig for a period of from about 0.05 to 20 hours. The introduction of oxygen into the reaction medium may also be initiated prior to the addition of the free radical initiator. The products of the reaction obtained have an excess of carboxylic acid as compared to hydroxy groups. This can occur by the further reaction of initially formed hydroperoxide groups or their decomposition products with the oxidizing agent.

The final polymeric product may be recovered from solution by evaporation of the solvent or by precipitation with a non-solvent or by any other suitable method. Alternatively, prior to removal of the inert solvent, a lubricating oil may be added directly to the reaction mixture and the inert solvent removed by vacuum distillation.

The additives can be made in batch or continuous operation. In batch operation, the individual components are added to a suitable reaction vessel together or in discrete portions and dissolved in an inert solvent. In continuous operation the reactant or reactants are added continuously to a horizontal or vertical reaction zone at appropriate feed rates in diluent or neat at temperatures to promote easy handling, reaction and solubility.

The hydroperoxidation is carried out in solvents relatively inert to the reaction conditions. Solvents such as toluene, xylene, or mineral neutral oils can be used. Preferred solvents are benzene, chlorobenzene, t-butylbenzene and the like.

The free radical initiators which may be peroxides, hydroperoxides and azo compounds, which may be used alone or as mixtures thereof, include, for example, cumene hydroperoxide, dicumyl peroxide, benzoyl peroxide, azo-bis(isobutyronitrile), tertiary butyl hydroperoxide, and the like. Preferably the free radical initiator is cumene hydroperoxide, dicumyl peroxide, and mixtures thereof. These free radical initiators have been conventionally employed in effecting hydroperoxidation of polymers and copolymers.

It has been found that the more vigorous the oxidation conditions and the longer the length of time maintaining such conditions, the greater the number of carboxyl groups introduced into the starting material. It is sufficient, however, that on an average at least one carboxyl is introduced into each molecule of the starting material.

The product produced by the hydroperoxidation reaction is an oil-soluble product of lower molecular weight than the starting material. The molecular weight depends upon the extent and conditions employed during the oxidation reaction. Ultimately, the intermediate hydroperoxidized polymers are converted by further oxidation reactions to fragmented or degraded polymer materials containing an excess of carboxylic acid groups over hydroxyls and wherein the carboxylated polymer materials have viscosity average molecular weight of from about one-half to about one-tenth of the molecular weight of the original material. The acid group content of the carboxylated polymers is in the range of from 1 to 50 mmole/100 g polymer, and preferably from 1 to 10 mmole/100 g, and most preferably from 2 to 6 mmole/100 g polymer.

When the carboxylic acid content and hydroxy content are given in terms of mmoles per 100 g of polymer, then the ratio of carboxy to hydroxy is greater than 1, preferably greater than 5 and most preferably greater than 10. The procedure for the determination of the acid group content and hydroxy group content and definition of the terms used therein is given in Example 1.

The copolymers or terpolymers of this invention are employed as additives in concentrations of from about 0.05 to 2 percent, preferably from between about 0.5 to 1 percent based on the lubricating oil composition being treated.

The compositions of this invention have a thickening power in the range of 7–40 cSt or more. "Thickening power" as used herein is defined as the viscosity at 100° C. of a neutral oil having a viscosity at 40° C. of 28.6 cSt and at 100° C. of 4.7 cSt, containing 2.8 weight percent of the dry polymeric composition. Thickening power is thus measured at an actual viscosity of the oil due to incorporation of the polymer. Thickening power is directly related to the molecular weight of the polymer, but is used instead of molecular weight because the ease of measurement and greater practical significance of data. While the thickening power of the compositions of this invention may be broadly defined as being in the range of 7–40 cSt, thickening power is more usually in the range of 15–35 cSt and, preferably, in the range of 15–25 cSt.

The carboxylated copolymers and terpolymers used in the compositions of this invention have an infrared spectrum having distinguishing absorbance peaks at frequencies of 1,370–1,380 $cm^{-1}$, 1,460–1,470 $cm^{-1}$, 1,700–1,750 $cm^{-1}$, and 2,800–3,000 $cm^{-1}$. Other peaks have been observed at 715–725 $cm^{-1}$ and 1,150–1,160$cm^{-1}$.

More specifically, the copolymers and terpolymers used in the compositions and method of this invention are the intermediate reactants described in U.S. Pat. Nos. 3,785,980 and 4,132,661, which intermediate polymers in each of these patents are subsequently reacted with an amine to form amidated polymers useful as viscosity index improvers and dispersants.

The base lubricating oil used in the compositions of the invention are oils of lubricating viscosity, and particularly of the type useful in internal combustion engines and can be predominantly paraffinic, 1-naphthenic or it can be a mixture of both types of mineral oils, as well as synthetic oils which include polymers of various olefins, generally of from 10 carbon atoms or higher, alkylated aromatic hydrocarbons, etc. In general, the base oil will be a relatively highly refined mineral oil of predominantly a paraffinic nature and will have a viscosity in the range of from 2 to about 20 cSt at 100° C.

Other additives, such as the detergents, rust inhibitors, anti-oxidants, anti-wear agents, etc., may also be present in the finished lubricant. These other additives will be present in conventional concentrations. Preferred additives which may be present in the lubricating oil in effective amounts, and preferably in the concentration range of from 0.01% to 5%, include neutral and overbased alkali and alkaline earth metal sulfonates or phenates or combinations thereof, a metal dihydrocarbyl dithiophosphate such as a zinc dialkyl dithiophosphate and an alkenyl succinimide or succinate or mixtures thereof.

The invention is further illustrated by the following examples, which are given without any intention that the invention be limited thereto.

EXAMPLE 1

A solution containing 8% by weight of an ethylene/propylene/1,4-hexadiene terpolymer (a product manufactured by Du Pont Company, Wilmington, Del. and sold under the trade name Ortholeum 2038, which is a terpolymer having about 60 mole percent ethylene groups, 39 mole percent propylene groups and 1 mole percent 1,4-hexadiene groups and having a molecular weight of about 250,000) in chlorobenzene was prepared and heated to 100° C. To this solution was continuously added at an appropriate rate in order to supply 4.2% by weight based on the weight of polymer of dicumyl peroxide and 1.8% by weight based on the weight of polymer of cumene hydroperoxide. The reaction mixture was continuously passed through a three-quarter inch stainless steel tubular reactor such that the residence time in the reactor was 2.75 minutes at a reaction temperature of 190° C. and a pressure of 200 psig. Air was continuously passed into the reactor tube at 0.35 $cm^2$/gm polymer at 200 psig. Sufficient 100 Neutral Oil was added to yield a 15% by weight of product in solution when the chlorobenzene solvent was removed. The chlorobenzene solvent was removed by distillation at reduced pressure. The viscosity or thickening power of the polymer product (viscosity at 100° C., 2.8% polymer in RPM 130N) was 17.8 cSt. The acid content was 4.8 mmole COOH/100 g polymer and the hydroxyl content was 0.28 mmole OH/100 g polymer as calculated below.

The acid and hydroxyl content was determined as follows:

A Determination of Acid Group Content 40.0 g of a solution of oxidized polymer intermediate in 100 neutral mineral oil (containing about 5–6 g of polymer) was dissolved in 100 ml of xylenes. 10.0 ml of 0.0999M NaOH solution was added, and the mixture was refluxed for 30 minutes. 75 ml of isopropyl alcohol was added followed by 1 ml of phenolphthalein indicator (0.1% in ethyl alcohol). The mixture was titrated to the phenolphthalein end point with 0.100N HCl. The acid functionality per 100 g of polymer is calculated using the formula below.

$$\frac{\text{mmole } RCO_2H}{100 \text{ g Polymer}} = \frac{(\text{ml NaOH} \times \text{M NaOH}) - (\text{ml HCl} \times \text{M HCl})}{\text{Wt of Polymer}} \times 100$$

$$\text{mmole } RCO_2H = \frac{(10.0 \times 0.0999) - (7.1 \times 0.100)}{5.85} \times 100$$

$$= 4.9 \text{ mmole } RCO_2H/100 \text{ g polymer}$$

A Determination of Hydroxyl Number

Description of Method

The dibutyl tin dilaurate-catalyzed reaction between alcohols and isocyanates was used to measure the hydroxyl content of the oxidized polymer. Using the reaction conditions described below, acid groups are not reactive, only hydroxyl functional groups are consumed. The difference in the concentration of isocyanate before and after reaction (as measured by infrared spectroscopy) indicates the amount of hydroxyl groups in the polymer.

Procedure

A solution of 1.00 g phenylisocyanate in 50 ml dry toluene was prepared. Several dilutions of the stock isocyanate solution were made and an infrared absorbance versus concentration curve was obtained using the IR absorbance at 2265 $cm^{-1}$ divided by the IR cell path length (in cm). The slope of this line gave a concentration factor of 0.118 mmole isocyanate/absorbance unit $cm^{-1}$.

100 g of a solution of oxidized polymer intermediate in 100 neutral mineral oil (containing about 12–15 g polymer) was treated with 2.0 ml of the isocyanate stock solution and 2 drops of dibutyl tin dilaurate catalyst. The mixture was stirred and heated at 80° C. for 100 min. A blank consisting of 100 g of 100 neutral mineral oil was run under the same conditions. An infrared spectrum of each solution was recorded in a 0.0171 cm path length NaCl cell. The hydroxyl group content was calculated from the isocyanate consumption by the polymer solution, correcting for subtracting the blank, using the formula below.

mmole OH/100 g polymer =

$$\frac{\dfrac{2265 \text{ blank} - 2265 \text{ poly}}{PL} \times (ICF)}{WP} \times 100$$

where

| | | |
|---|---|---|
| 2265 poly | = | *IR* absorbance for polymer solution |
| 2265 blank | = | *IR* absorbance for blank solution |
| *ICF* | = | isocyanate concentration factor $\left(0.118 \dfrac{\text{mmole isocyanate}}{ABS \cdot cm^{-1}}\right)$ |
| *PL* | = | *IR* cell path length (cm) |
| *WP* | = | Weight of polymer |

mmole OH/100 g polymer =

$$\frac{\dfrac{(0.027 - 0.021)}{0.0171 \text{ cm}} ABS \dfrac{(0.118 \text{ mmole})}{ABS \text{ cm}^{-1}}}{15.0} (100) =$$

0.28 mmole OH/100 g polymer

Thus the product of Example 1 had a COOH:OH ratio of 4.9:0.28 or about 19:1.

EXAMPLE 2

A solution containing 8% by weight of the ethylene/propylene/1,4-hexadiene terpolymer of Example 1 in chlorobenzene was prepared and heated to 100° C. To this solution was continuously added at an appropriate rate in order to supply 0.2% by weight based on the weight of polymer of dicumyl peroxide. The reaction mixture was continuously passed through a three-quarter inch stainless steel tubular reactor such that the residence time in the reactor was 2.75 minutes at a reaction temperature of 190° C. and a pressure of 200 psig. Air was continuously passed into the reactor tube at 1.7 $cm^2$/gm polymer at psig. Sufficient 100 neutral oil was added to yield a 15.7% by weight of product in solution when the chlorobenzene solvent was removed. The chlorobenzene solvent was removed by distillation at reduced pressure. The viscosity or thickening power of the polymer product (viscosity at 100° C., 2.8% polymer in RPM 130N) was 17.8 cSt, the acid content was 4.3 mmole COOH/100 g polymer and the hydroxyl content was 0.06 mmole OH/100 g polymer giving a ratio of 4.3 to 0.06 or about 72:1 acid to hydroxyl. Multigrade lubricating oils with good dispersancy characteristics may be prepared using the product of this example.

EXAMPLE 3

Thirty parts of the commercial ethylene/propylene/1,4-hexadiene terpolymer of Example 1 was dissolved in 365 parts of xylene at 200° F. over a period of about 16 hours with stirring. The temperature was raised to 250° F. and 0.118 parts dicumyl peroxide was added to the polymer solution. An air sparge of 1 $ft^3$/min was used to introduce oxygen into the polymer solution over a period of about 6 hours. Sufficient 100 Neutral Oil was added to yield a 12% by weight of product in solution when the xylene solvent was removed. The xylene solvent was removed by distillation at reduced pressure. The viscosity or thickening power of the polymer product (viscosity at 100° C., 2.8% dry polymer in RPM 130N) was 16 cSt.

EXAMPLE 4

Thirty pounds of an ethylene/propylene copolymer rubber (a product manufactured by B. F. Goodrich and sold under the trade name EPCAR 405 which is an ethylene/propylene copolymer having about 60 mole percent ethylene and 40 mole percent propylene and having a Mooney viscosity of 60) was dissolved in 345 pounds of chlorobenzene at 210° F. over a period of about five hours. The temperature was raised to 250° F. and 270 ml of a 10% by weight dicumyl peroxide was added to the polymer solution. An air sparge of 0.5 $ft^3$/min was used to introduce oxygen into the solution over a period of about 5 hours. An additional 25 ml of 10 percent by weight dicumyl peroxide was added every 30 minutes over the 5-hour reaction period. After a nitrogen sparge for 30 minutes, sufficient 100 neutral oil was added to yield a 12% by weight of product in solution when the chlorobenzene was removed. The chlorobenzene solvent was removed by distillation at reduced pressure. The viscosity or thickening power of the polymer product (viscosity at 100° C., 2.8% dry polymer in RPM 130N) was 17 cSt. The acid content was 5.8 mmoles COOH/100 g polymer and the hydroxyl content was 0.23 mmoles OH/100 g polymer giving a ratio of 5.8:0.23 or about 25:1 acid to hydroxyl.

Multi-grade lubricating oil with good dispersancy characteristics may be prepared using the product of this Example.

EXAMPLE 5

The lubricating oil compositions of this invention were evaluated in the standard Sequence V-D automotive engine test and the 1-G2 caterpillar engine test. In the Sequence V-D and 1-G2 engine tests, lubricants containing the experimental additives are charged respectively to a standard internal combustion engine and to a diesel engine. The engines are operated at an assigned load and temperature, and at the end of a prescribed time the engines are disassembled and examined for deposits and wear. These engine tests are standard methods well known in the industry.

Also, viscosity measurements at 100° C., 40° C. and 0° C. show acceptable viscosity measurements and with the use of pour point depressants, acceptable viscosity measurements at −32° C. are obtained.

A. Standard Sequence V-D Engine Test

Formulated 10 W-40 oils containing the additives shown in Table I were prepared and tested in a Sequence V-D Test method phase 9–2 (according to candidate test for ASTM) as shown in Table II. This procedure utilizes a Ford 2.3-liter four-cylinder engine. The test method simulates a type of severe field test service characterized by a combination of low speed, low temperature "stop and go" city driving and moderate turnpike operation. The effectiveness of the additives in the oil is measured in terms of the protection provided against deposits and valve train wear.

TABLE I

| | Test Oil Formulations (mmoles/kg except where noted) | | | | | | |
|---|---|---|---|---|---|---|---|
| | A[1] | B[2] | C[2] | D[5] | E[5] | F[2,3] | G[2,4] |
| Product of Example 1 | 1.73% | — | 1.73% | — | — | — | — |
| Product of Example 3 | — | 1.65% | — | — | — | — | — |
| Amine functionalized olefin terpolymer | — | — | — | — | — | 1.70% | — |
| Olefin copolymer | — | — | — | — | — | — | 0.55% |
| Calcium phenate | 20 | 20 | 20 | 20 | 20 | 20 | 20 |
| Zinc dialkyl phosphate | 22.5 | 22.5 | 22.5 | 22.5 | 22.5 | 22.5 | 22.5 |
| Overbased calcium sulfonate | 30 | — | 30 | 30 | 30 | 30 | 30 |
| Polyisobutenyl succinimide (50% concentrate in oil) | — | 1.5% | 6% | — | 6% | — | — |
| Overbased magnesium sulfonate | — | 30 | — | — | — | — | — |

[1]Exxon 150N Oil formulated to 10W-40

[2]Sun 148N Oil formulated to 10W-40

[3]V.I. improver prepared by the condensation of an alkylene polyamine with a hydroperoxidized ethylene-propylene-1,4 hexadiene terpolymer as described in U.S. Pat. No. 3,785,980.

[4]Paratone 716, a non-dispersant, non-hydroperoxidized olefin copolymer V.I. improver commercially available from Exxon Chemicals.

[5]Exxon 150N Oil.

The data in Table II demonstrate that formulations A, B and C containing the hydroperoxidized polymers of this invention have dispersant properties better than an ethylene copolymer V.I. improver and comparable to an amine functionalized hydroperoxidized ethylene terpolymer of the prior art.

TABLE II

| | Sequence V-D Performance | | | | |
|---|---|---|---|---|---|
| | | | | Com Lobe Wear $\times 10^{-3}$ – Inch | |
| Test Oil | Average Sludge | Piston Varnish | Average Varnish | Average | Maximum |
| A | 7.2 | 6.6 | 6.6 | 0.5 | 0.9 |
| B | 9.7 | 6.7 | 5.0 | 0.5 | 0.9 |
| C | 9.7 | 7.2 | 7.0 | 0.5 | 0.8 |
| D | 6.4 | 6.4 | 6.3 | 2.7 | 8.3 |
| E | 9.6 | 6.8 | 6.8 | 0.4 | 0.5 |
| F | 5.9 | 6.6 | 7.1 | 0.4 | 0.6 |
| G | 6.5 | 5.6 | 5.1 | 0.6 | 0.7 |

B. Caterpillar 1-G2 Test

The compositions of this invention were tested in a Caterpillar 1-G2 test in which a single-cylinder diesel engine having a 5⅛" bore by 6½" stroke is operated under the following conditions: timing, degrees BTDC, 8; brake mean effective pressure, psi 141; brake horsepower 42; Btu's per minute 5850; speed 1800 RPM; air boost, 53" Hg absolute, air temperature in, 255° F.; water temperature out, 190° F.; and sulfur in fuel, 0.4% w. At the end of each 12 hours of operation, sufficient oil is drained from the crankcase to allow addition of 1 quart of new oil. In the test on the lubricating oil compositions of this invention, the 1-G2 test is run for 60 and 120 hours. At the end of the noted time period, the engine is dismantled and rated for cleanliness. The Institute of Petroleum Test Number 247/69 merit rating system for engine wear and cleanliness, accepted by ASTM, API and SAE, is the rating system used to evaluate the engine. The over-all cleanliness is noted as WTD, which is the summation of the above numbers. Lower values represent cleaner engines.

The base oil used in this test is a Sun Tulsa 148N/250N base oil formulated with sufficient viscosity index-dispersant (about 12% by weight) to prepare a 15 W-40 oil containing 3% of a 50% concentrate in oil of an isobutenyl succinimide, 10 mmoles/kg calcium sulfonate, 20 mmoles/kg overbased calcium phenate, 45 mmoles/kg overbased magnesium sulfonate; 18 mmoles zinc dialkyl dithiophosphate, 1% combination of cracked wax olefin and sulfurized calcium phenate. Formulation H in Table III contains the viscosity index-dispersant of Example 1, and formulation I contains the amine functionalized olefin terpolymer used in formulation F in Table 1.

TABLE III

| | Caterpillar 1-G2 Test | | | | |
|---|---|---|---|---|---|
| Formulation | Time - Hrs. | Groves | Lands | Top Grove Fill % | WTD |
| H | 60 | 59-94-8-0 | 40-9-7 | 58 | 216 |
| | 120 | 73-115-3-5 | 57-7-9 | 73 | 268 |

TABLE III-continued

| Formulation | Time - Hrs. | Caterpillar 1-G2 Test Groves | Lands | Top Grove Fill % | WTD |
|---|---|---|---|---|---|
| I | 120 | 90-171-3-6 | 76-14-29 | 89 | 388 |

What is claimed is:

1. A lubricating oil composition comprising an oil of lubricating viscosity and from about 0.05 to 2% of a dispersancy and viscosity index improving hydroperoxidized copolymer of ethylene and one or more alpha-olefins or hydroperoxidized terpolymer of ethylene, one or more alpha-olefins and one or more non-conjugated diolefins wherein said hydroperoxidized copolymer and hydroperoxidized terpolymer have an excess of carboxylic acid to hydroxy groups and are prepared by dissolving in a solvent a copolymer of ethylene and a $C_3$–$C_{18}$ alpha-olefin or a terpolymer of ethylene, a $C_3$–$C_{18}$ alpha-olefin and a $C_5$–$C_{12}$ non-conjugated diolefin, wherein said copolymer or terpolymer has molecular weight in the range of 20,000 to 1,000,000, reacting the copolymer or terpolymer with oxygen in the presence of a free radical initiator, the reaction being carried out at a temperature of from 60° to 250° C. and under a pressure of 0 to 1000 psig.

2. The lubricating oil composition of claim 1 wherein the copolymer of ethylene comprises from 30 to 80 mole percent ethylene and 70 to 20 mole percent propylene and the terpolymer of ethylene comprises from 30 to 80 mole percent ethylene, 70 to 20 mole percent propylene and 0.1 to 15 mole percent of a $C_5$ to $C_{12}$ non-conjugated diolefin.

3. The lubricating oil composition of claim 2 wherein the terpolymer of ethylene contains from 1.0 to 10 mole percent of a $C_5$ to $C_{12}$ non-conjugated diolefin.

4. The lubricating oil composition of claim 3 wherein the non-conjugated diolefin is 1,4-hexadiene.

5. The lubricating oil composition of claim 1 wherein the free radical initiator catalyst is selected from the group consisting of dicumyl peroxide and cumene hydroperoxide and mixtures thereof.

6. A method of improving the sludge and varnish dispersancy properties and increasing the viscosity index of an oil of lubricating viscosity which comprises incorporating in said lubricating oil from about 0.05 to 2% of a dispersancy and viscosity index improving hydroperoxidized copolymer of ethylene and one or more alpha-olefins or hydroperoxidized terpolymer of ethylene, one or more alpha-olefins and one or more non-conjugated diolefins wherein said hydroperoxidized copolymer and hydroperoxidized terpolymer have an excess of carboxylic acid to hydroxy groups and are prepared by dissolving in a solvent a copolymer or ethylene and a $C_3$–$C_{18}$ alphaolefin or a terpolyer of ethylene, a $C_3$–$C_{18}$ alphaolefin and a $C_5$–$C_{12}$ non-conjugated diolefin, wherein said copolymer or terpolymer has a molecular weight in the range of 20,000 to 1,000,000, reacting the copolymer or terpolymer with oxygen in the presence of a free radical initiator, the reaction being carried out at a temperature of from 60° to 250° C. and under a pressure of 0 to 1000 psig.

7. The method of claim 6 wherein the copolymer of ethylene comprises from 30 to 80 mole percent ethylene and 70 to 20 mole percent propylene and the terpolymer of ethylene comprises from 30 to 80 mole percent ethylene, 70 to 20 mole percent propylene and 0.1 to 15 mole percent of a $C_5$ to $C_{12}$ non-conjugated diolefin.

8. The method of claim 7 wherein the terpolymer of ethylene contains from 0.1 to 10 mole percent of a $C_5$ to $C_{12}$ non-conjugated diolefin.

9. The method of claim 8 wherein the non-conjugated diolefin is 1,4-hexadiene.

10. The method of claim 6 wherein the free radical initiator catalyst is selected from the group consisting of dicumyl peroxide and cumene hydroperoxide and mixtures thereof.

11. In the method of lubricating the crankcase of an internal combustion engine by contacting the surfaces of said engine with an oil of lubricating viscosity, the improvement wherein a sufficient amount of a hydroperoxidized copolymer of ethylene and one or more alpha-olefins or hydroperoxidized terpolymer of ethylene, one or more alpha-olefins and one or more non-conjugated diolefins wherein said hydroperoxidized copolymer and hydroperoxidized terpolymer have an excess of carboxylic acid to hydroxy groups and are prepared by dissolving in a solvent a copolymer of ethylene and a $C_3$–$C_{18}$ alpha-olefin or a terpolymer of ethylene, a $C_3$–$C_{18}$ alpha-olefin and a $C_5$–$C_{12}$ non-conjugated diolefin, wherein said copolymer or terpolymer has a molecular weight in the range of 20,000 to 1,000,000, reacting the copolymer or terpolymer with oxygen in the presence of a free radical initiator, the reaction being carried out at a temperature of from 60° to 250√ C. and under a pressure of 0 to 1000 psig, is added to the oil in order to improve the dispersancy and viscosity index of the oil.

12. The method of claim 11 wherein the copolymer of ethylene comprises from 30 to 80 mole percent ethylene and 70 to 20 percent propylene and the terpolymer of ethylene comprises from 30 to 80 mole percent ethylene, 70 to 20 mole percent propylene and 0.1 to 15 mole percent of a $C_5$–$C_{12}$ non-conjugated diolefin.

13. The method of claim 12 wherein the terpolymer of ethylene contains from 0.1 to 10 mole percent of a $C_5$ to $C_{12}$ non-conjugated diolefin.

14. The method of claim 13 wherein the non-conjugated diolefin is 1,4-hexadiene.

15. The method of claim 11 wherein the free radical initiator catalyst is selected from the group consisting of dicumyl peroxide and cumene hydroperoxide and mixtures thereof.

* * * * *